US007819685B2

(12) United States Patent
Hardell

(10) Patent No.: US 7,819,685 B2
(45) Date of Patent: Oct. 26, 2010

(54) BOARD CONNECTOR

(75) Inventor: David A. Hardell, San Jose, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 12/467,165

(22) Filed: May 15, 2009

(65) Prior Publication Data

US 2009/0221155 A1 Sep. 3, 2009

Related U.S. Application Data

(62) Division of application No. 10/930,165, filed on Aug. 30, 2004, now Pat. No. 7,540,742.

(51) Int. Cl.
*H01R 13/62* (2006.01)

(52) U.S. Cl. ..... 439/328; 439/571

(58) Field of Classification Search ..... 439/327–328, 439/157–160, 630
See application file for complete search history.

(56) References Cited

U.S. PATENT DOCUMENTS

| | | | | |
|---|---|---|---|---|
| 3,961,228 | A | 6/1976 | Briggs et al. | |
| 4,938,701 | A | 7/1990 | Heberling | |
| 5,295,852 | A | 3/1994 | Renn et al. | |
| 5,316,488 | A | 5/1994 | Gardner et al. | |
| 5,415,573 | A | 5/1995 | Chen et al. | |
| 5,425,651 | A | 6/1995 | Thrush et al. | |
| 5,472,354 | A | 12/1995 | Chen et al. | |
| 5,531,615 | A | 7/1996 | Irlbeck et al. | |
| 5,755,585 | A | 5/1998 | Cheng et al. | |
| 5,833,478 | A | 11/1998 | Tseng et al. | |
| 5,853,297 | A * | 12/1998 | Moulton et al. | 439/327 |
| 5,876,220 | A | 3/1999 | Yeh | |
| 6,027,357 | A * | 2/2000 | Howell et al. | 439/326 |
| 6,109,927 | A | 8/2000 | Scholz et al. | |
| 6,135,797 | A | 10/2000 | McCleerey et al. | |
| 6,174,176 | B1 | 1/2001 | Hong | |
| 6,319,035 | B1 | 11/2001 | Choy | |
| 6,413,109 | B1 | 7/2002 | Kobayashi et al. | |
| 6,520,789 | B2 | 2/2003 | Daugherty, Jr. et al. | |
| 6,663,407 | B1 | 12/2003 | Pickles | |

(Continued)

FOREIGN PATENT DOCUMENTS

EP 0 499 378 A2 8/1992

(Continued)

OTHER PUBLICATIONS

PCT Invitation to pay additional fees for PCT Appln No. US2005/029461, mailed Jan. 16, 2006 ( 8 pages ).

(Continued)

*Primary Examiner*—Renee Luebke
*Assistant Examiner*—Larisa Tsukerman
(74) *Attorney, Agent, or Firm*—Blakely, Sokoloff, Taylor & Zafman LLP

(57) ABSTRACT

A card connector that allows a card to be at least partially coplanar with a logic board is described herein. A system having a card at least partially coplanar with a logic board is also disclosed. A card connector that allows at least one longitudinal plane through the logic board to intersect at least a point of the card is also disclosed. The card may be a memory module.

40 Claims, 16 Drawing Sheets

U.S. PATENT DOCUMENTS

| | | | |
|---|---|---|---|
| 6,666,702 | B1 | 12/2003 | Pickles |
| 6,722,920 | B2 | 4/2004 | Zhang |
| 6,917,683 | B2 | 7/2005 | Singaliese et al. |
| 6,997,752 | B2 | 2/2006 | Kato et al. |
| 2002/0076986 | A1 | 6/2002 | Cochran et al. |
| 2002/0137379 | A1 | 9/2002 | Yu |
| 2003/0139093 | A1 | 7/2003 | Zhang |
| 2004/0038563 | A1 | 2/2004 | Chin-Lung et al. |
| 2004/0058577 | A1 | 3/2004 | Ku |

FOREIGN PATENT DOCUMENTS

| | | | |
|---|---|---|---|
| EP | 0 520 080 | A1 | 12/1992 |
| EP | 1 365 480 | A1 | 11/2003 |

OTHER PUBLICATIONS

PCT International Search Report, International Application No. PCT/SG2005/029461; International Filing Date, Aug. 8, 2005; mailing date, May 16, 2006 (9 pp.).

PCT International Preliminary Report on Patentability and Written Opinion, International Application No. PCT/SG2005/029461; International Filing Date, Aug. 17, 2005; Mailing date, Mar. 8, 2007(12 pp.).

* cited by examiner

BOARD CONNECTOR

This application is a divisional of co-pending U.S. patent application Ser. No. 10/930,165 filed on Aug. 30, 2004 now U.S. Pat. No. 7,540,742.

FIELD OF THE INVENTION

The present invention relates to data processing systems, such as computers, and in particular, a connector for a logic board in a data processing system.

BACKGROUND OF THE INVENTION

Most contemporary data processing systems, such as computers, portable media players, and the like, include logic boards and memory modules, which are connected to the logic board by a connector.

In conventional computers, the memory modules are positioned vertically relative to the logic board. However, with laptop computers and other data processing systems having streamlined enclosures, height and thickness limitations prevent vertical positioning of the memory modules.

Accordingly, new technology has been developed which enables memory modules to be connected to the logic board horizontally relative to the logic board, such that the plane of a memory module is parallel to the plane of the logic board.

FIG. 1 illustrates one such prior art system. The connector 100 is perpendicularly installed on the top surface of the logic board 130, such that the connector slot 108 is horizontally directed. A memory module 140 is inserted into the horizontally-directed connector slot 108, such that the memory module 140 is kept above and parallel to the logic board 130. A longitudinal axis Ca extends through the center of the connector slot 108 and is positioned parallel to a longitudinal axis Ba extending through the logic board 130.

FIG. 1A is a side cross-sectional view showing the connector of the prior art, which enables horizontal attachment of the memory module to the logic board. The connector 100 is fixed on the logic board 130 by the multiple terminal posts 113 penetrating the board surface.

The prior connectors, as illustrated in FIG. 1A, still take up a significant amount of space within the enclosure of laptop computers or other data processing systems, preventing further streamlining and limiting airflow within the enclosure.

SUMMARY OF THE DESCRIPTION

In accordance with one embodiment of the present invention, a system including a housing, a logic board having a longitudinal plane disposed within the housing, a memory module, and a connector, attached to the logic board and configured to receive the memory module, is provided. The housing is in close proximity to a surface of the memory module. At least a portion of the memory module is at least partially coplanar with the longitudinal plane of the logic board.

In accordance with one embodiment of the present invention, a system including a logic board having a longitudinal plane, an auxiliary logic board having circuitry thereon, and a connector, attached to the logic board and configured to receive the auxiliary logic board, is provided. At least a portion of the auxiliary logic board is coplanar with the longitudinal plane of the logic board.

In accordance with one embodiment of the present invention, a system including a logic board having a longitudinal plane, a memory module, positioned coplanar to the longitudinal plane of the logic board, and a connector, attached to the logic board and configured to receive the memory module, is provided.

In accordance with one embodiment of the present invention, a system including a logic board, a card, and a connector, attached to the logic board and configured to receive the card is provided. The connector includes an attachment element, adapted to be moveable to a first position, wherein the attachment element receives the card. and moveable to a second position, wherein the attachment element locks the card such that at least a portion of the card is coplanar with the logic board.

In accordance with one embodiment of the present invention, a system including a logic board, a card, and a connector, attached to the logic board and configured to receive the card is provided. The connector includes an attachment element, adapted to be moveable to a first position, wherein the attachment element is angled to receive the card, and moveable to a second position, wherein at least a portion of the attachment element is coplanar with at least a portion of the logic board, such that at least a portion of the card is coplanar with the logic board.

In accordance with one embodiment of the present invention, an apparatus including a connector body configured to contact at least two sides of a logic board, and a connecting element, attached to the connector body and configured to receive an auxiliary logic board is provided.

In accordance with one embodiment of the present invention, a system including a logic board having a body and a first tab and a second tab, a connector, attached to the logic board, and a support rail, attached to the connector and the logic board is provided.

In accordance with one embodiment of the present invention, a system including a logic board having a longitudinal plane, a card, positioned coplanar to the longitudinal plane of the logic board, and a connector, attached to the logic board and configured to receive the card is provided. The connector includes a support rail, extending laterally away from the connector. The support rail is also configured to receive the card.

In accordance with one embodiment of the present invention, a system including a logic board having a body, a first tab, a second tab, and a longitudinal plane running through the body, first tab, and second tab, a card, positioned at least partially coplanar to the longitudinal plane of the logic board, having at least one edge, and a connector, attached to the logic board, and configured to receive the card, is disclosed herein. The connector includes a support rail, which extends laterally and away from the connector to the first and second tabs, and is configured to support at least one edge of the card.

In accordance with one embodiment of the present invention, a system including a logic board having a longitudinal plane, an auxiliary logic board, positioned coplanar to the longitudinal plane of the logic board, having a high number of connections, and a connector, attached to the logic board, and configured to receive the auxiliary logic board is provided. The connector includes a high number of connections (e.g., over 30 connections) corresponding to the high number of connections of the auxiliary logic board.

In accordance with one embodiment of the present invention, a system including a logic board having a longitudinal plane, a first auxiliary logic board, positioned coplanar to the longitudinal plane of the logic board, and a first connector, attached to the logic board and configured to receive the first auxiliary logic board is provided. A second auxiliary logic board, positioned parallel to the longitudinal plane of the logic board, and a second connector, attached to the logic board and configured to receive the second auxiliary logic board, is also provided.

In accordance with one embodiment of the present invention, a system including a logic board having a longitudinal plane, an auxiliary logic board having circuitry thereon, and a connector, attached to the logic board and configured to receive the auxiliary logic board is provided. the longitudinal plane of the logic board intersects at least a point of the auxiliary logic board.

BRIEF DESCRIPTION OF THE DRAWINGS

The invention may best be understood by referring to the following description and accompanying drawings that are used to illustrate embodiments of the invention. In the drawings.

DETAILED DESCRIPTION OF THE PREFERRED EMBODIMENTS

The following detailed description presents various specific embodiments of the present invention. However, the present invention can be embodied in a multitude of different forms as defined and covered by the claims. In this description, reference is made to the drawings wherein like parts are designated with like numerals throughout.

A system and apparatus for enabling attachment of an auxiliary logic board, such as a memory module, to a logic board, such that at least a portion of the auxiliary logic board is at least partially coplanar with the logic board is disclosed herein. The various embodiments may be used in a variety of systems and form factors. For example, it may be used in data processing systems such as laptop computers or desktop computers or in digital media players such as MP3 music players, and the like.

For simplicity, the system and apparatus are described as enabling attachment of a memory module to a logic board, both of which typically include a plurality of integrated circuits (ICs) and some discrete circuit components. It is envisioned that any auxiliary logic board having circuitry may be attached to the logic board. It is also envisioned that the auxiliary logic board may be a card. An example of a memory module, in accordance with the present invention, is described in JEDEC Standard No. 21C, Release 13, Section 4.20.6, PC3200/PC27001/PC2100/PC1600 DDR SDRAM Unbuffered SO-DIMM, Jan. 13, 2003, which is herein incorporated by reference, and other related standards. In some embodiments, all of the memory for the computer or other data processing system is provided on the memory module. In some other embodiments, a portion of the memory is provided on the memory module. The memory module may include any type of memory. In some embodiments, the memory module may include dynamic RAM (Random Access Memory).

Similarly, the system and apparatus are described with respect to a logic board. The logic board may be a main board, a main circuit board, a mother board, and the like, as commonly known to those of skill in the art.

Figure 2:
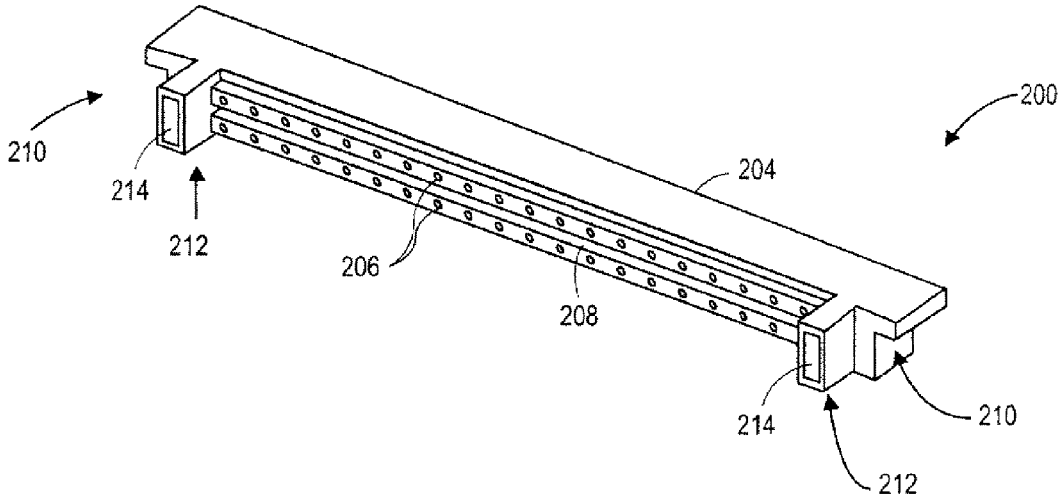
FIG. 2 is a perspective view of a connector in accordance with one embodiment of the present invention.
Figure 3:
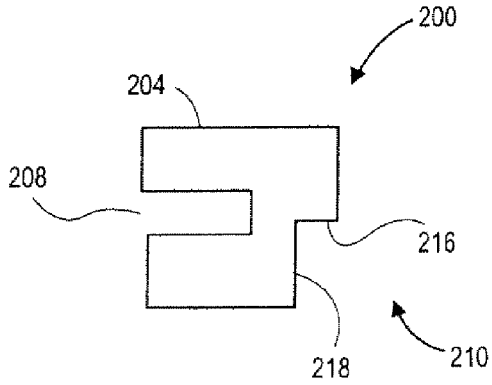
FIG. 3 is a side view of the connector of FIG. 2.

With reference to FIGS. 2-3, one embodiment of a connector in accordance with the present invention is shown. Connector 200 includes a body 204, a plurality of contacts 206, and a connection slot 208.

Connection slot 208 is adapted to receive a memory module (not shown) or other logic board, as will be described hereinafter. Plurality of electrically conductive contacts 206 are adapted to electrically couple the memory module and logic board (not shown). Each of the contacts 206 typically electrically connects one signal line on the memory module to another signal line on the logic board. Connector body 204 may also include a connecting element (not shown) for mechanically coupling the connector 200 to the logic board, as known to those of skill in the art.

Connector body 204 may also include a pair of projections 212. Projections 212 each include an opening 214, adapted to receive a support element (not shown), as will be described hereinafter with reference to FIG. 5, which support element is designed to support the memory module. In an alternative embodiment, openings 214 are formed in the connector body 204. Connector body 204 also includes a board conforming portion 210.

Referring to FIG. 3, board conforming portion 210 includes a first conforming wall 216 and a second conforming wall 218. First and second conforming walls 216, 218 may be perpendicular to one another to conform to a generally rectangular logic board (not shown), as will be described hereinafter with reference to FIG. 6.

The connector body 204 may be made of any suitable material or combination of materials, including, for example, a plastic material, a composite material, a circuit board material, and the like. In one embodiment, the connector body 204 is made of a high-temperature plastic, which is an insulator.

In one embodiment, the connector body 204 has a length of about 75 mm, a width of about 8 mm and a height of about 4 mm. In one embodiment, the first conforming wall 216 has a width of about 2.5 mm and the second conforming wall 218 has a height of about 2 mm. The dimensions provided are for exemplary purposes. The actual dimensions may depend on the dimensions of the housing in which the connector resides, the dimensions of the logic board, the dimensions of the memory module, and other such factors, as known to those of skill in the art.

In one embodiment, the connector body 204 is injection molded. Other methods of manufacturing the connector body 204 may be used, as known to those of skill in the art. The plurality of contacts 206 may also be made of any suitable material and using any suitable techniques, as known to those of skill in the art.

Figure 4B:
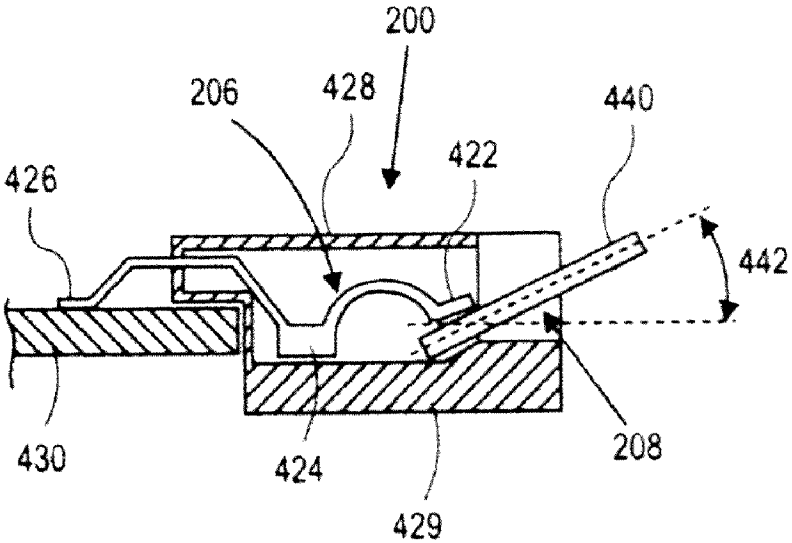
FIGS. 4A-B are cross-sectional side views of the connector of FIG. 2.
Figure 4A:
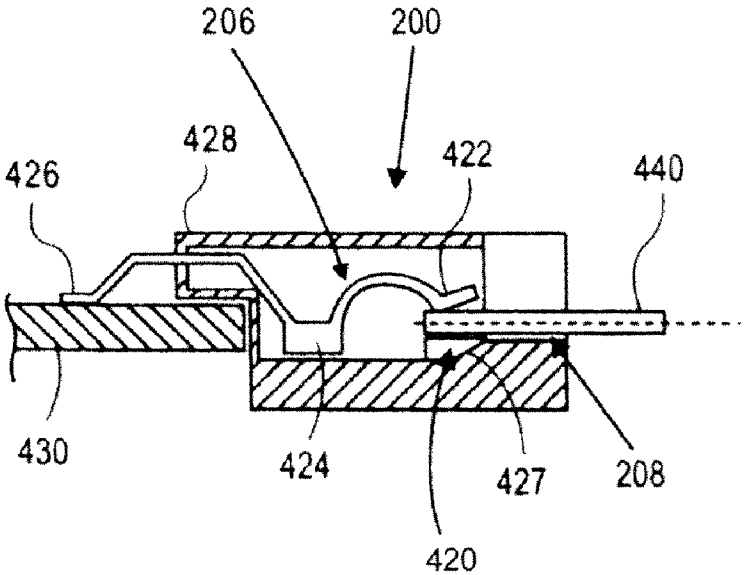

With reference to FIGS. 4A and 4B, a cross-sectional view of connector 200 is shown. Connector 200 includes a plurality of contacts 206 and a connector slot 208.

Connector 200 is shown connected to a logic board 430 and a memory module 440. Logic board 430 and memory module 440 will be discussed in more detail with reference to FIGS. 6-13.

The plurality of contacts 206 provide an electrical (electrically conductive) connection between the memory module 440 and the logic board 430. In some embodiments, each of the contacts 206 include a first contacting portion 422, a second contacting portion 424 and a third contacting portion 426. The first contacting portion 422 is configured to contact (both physically and electrically) a conductor on a top surface of the memory module. The second contacting portion 424 is configured to contact connector 200. The third contacting portion 426 is configured to contact (both physically and electrically) a conductor on the logic board and electrically couple the connector and the logic board. In one embodiment, the first contacting portion 422, second contacting portion 424 and third contacting portion are integral. The third contacting portion 426 may be soldered to its corresponding contact on the logic board, and this soldered connection provides both a physical and electrical connection.

Connector slot 208 is adapted to receive the memory module 440. Connector slot 208 may include an opening 420 having a slanted wall 427, enabling the memory module to rotate within the connector slot 408. Additionally, the top surface 428 of connector body 204 may be shorter (in the distance it extends away from the logic board 430) than the bottom surface 429 of connector body 204 to further enable rotation of memory module.

In some embodiments, memory module is inserted into the connector slot 208 in a first position, as shown in FIG. 4B. The memory module may be inserted into the connector slot 208 in the first position at an angle 442 (which is the angle between the first position and the second position). Angle 442 may be any value or range of values between about 0° and 90°. In one embodiment, angle 442 is about 25°. The angle 422 of insertion may in some embodiments be the same as the slope of wall 428. As discussed above, the top surface 428 may be shorter than the bottom surface, such that the memory module can be inserted in the first position at the angle 422.

In some embodiments, the memory module may then be adjusted to a second position, wherein at least a portion of the memory module is at least partially coplanar (e.g., sharing at least a portion of the same plane) with the logic board (see FIG. 4A). In some embodiments, the memory module is adjusted by rotating the memory module.

In some other embodiments, the memory module is inserted in the connector slot 208 directly into the second position without being placed in an initial first position (i.e., angle 422 is 0°), as shown in FIG. 4A.

Figure 5:
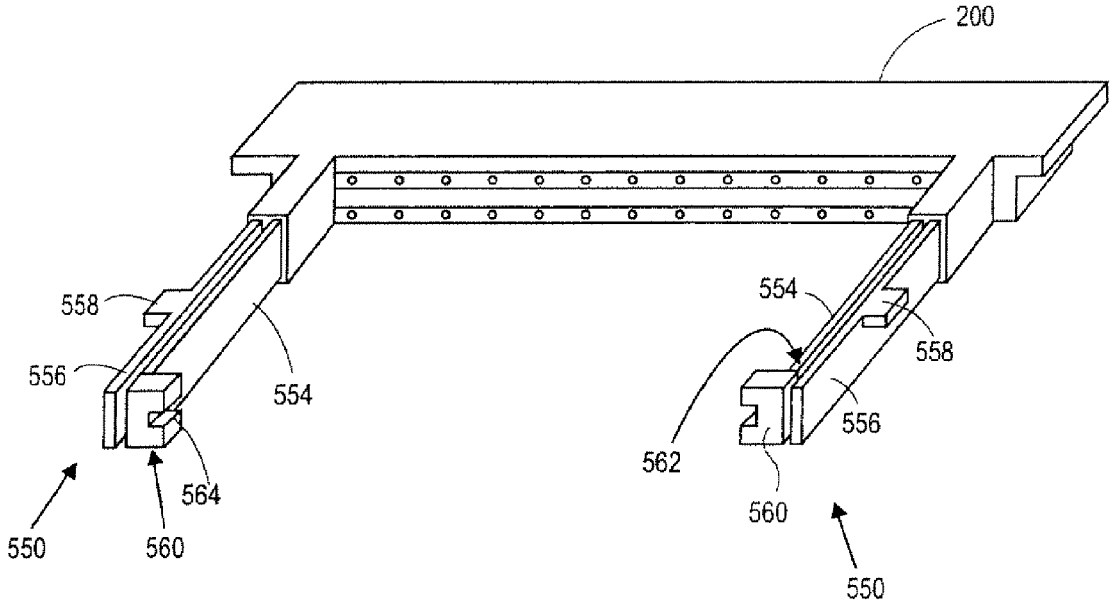
FIG. 5 is a perspective view of a connector with a support rail.

FIG. 5 is a perspective view of a connector in accordance with one embodiment of the present invention. In some embodiments, connector 200 may include a support element 550 and a support attachment element 560 at each end of connector 200. In some embodiments, support element 550 and support attachment element 560 are a support rail. In some embodiments, support element 550 is integral with connector 200. In some embodiments, one end of the first and second arms 554, 556 is adapted to be inserted into opening 214 of connector 200 (see FIG. 2).

In some embodiments, support element 550 includes a first arm 554, a second arm 556, and a support tab 558.

In some embodiments, the support tab 558 is provided on second arm 556. In some embodiments, the support tab 558 is integral with second arm 556. In some other embodiments, support tab 558 is mechanically attached to second arm 556. Examples of mechanical attachment include, for example, fastening, gripping, bonding, and the like.

In some embodiments, the support element 550 includes a plurality of support tabs. The support tab 558 attaches to at least one surface of the logic board, such as, for example, the top surface of the logic board. In some embodiments, the support tab can be soldered onto the logic board to securely attach the support element 550 to the logic board. In some other embodiments, support tab may be mechanically attached to the logic board. In one embodiment, support tab includes a fastener which is inserted into an opening in the logic board. In one embodiment, the support tab may include first and second gripping parts (not shown) to securely grip the logic board. In still other embodiments, the support tab may be attached to the logic board with an adhesive.

The support element 550 is formed from any suitable material. In some embodiments, the support element 550 is metallic or plastic.

In some embodiments, the support attachment element 560 is integral with the support element 550. In some embodiments, the support attachment element 560 is releasably attached to the support element 550. In some embodiments, the support attachment 560 is attached to the first arm 554 of the support element 550. In some embodiments, support attachment element 560 includes a first attaching portion 562 and a second attaching portion 564.

First attaching portion 562 secures the support attachment element 560 to the end of the support element 550. In one embodiment, first attaching portion 562 is a solder ball, enabling the support attachment element 560 to be soldered to the support element 550. In some other embodiments, the first attaching portion 562 may mechanically attach the support attachment element 560 to the support element 550. Examples of mechanical attachment include, for example, fastening, gripping, bonding, and the like.

Second attaching portion 564 attaches the memory module to the support element 550. In some embodiments, second attaching portion 564 releasably secures the memory module to the support element 550. In one embodiment, the second attaching portion 564 grips the memory module.

The support attachment element 560 is formed from any suitable material. In some embodiments, the support attachment element 560 is plastic while in other embodiments the support attachment element 560 is metallic. The support attachment element 560 is made by any suitable method. In some embodiments, the support attachment element is injection molded.

Figure 6:
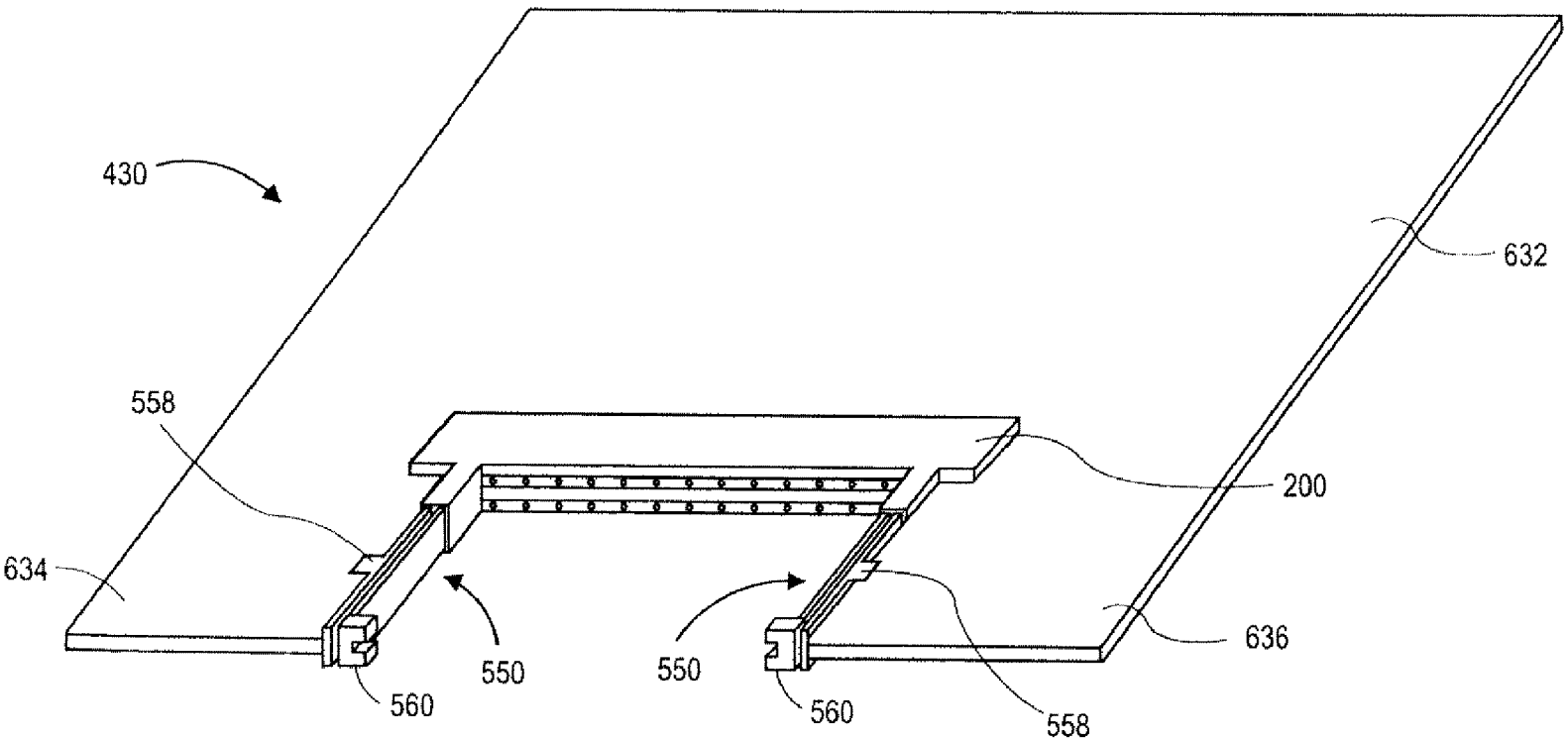
FIG. 6 is a perspective view of a connector attached to a logic board in accordance with one embodiment of the present invention.

Referring to FIG. 6, in accordance with one embodiment of the present invention, a connector 200 is shown attached to a logic board 430.

In some embodiments, logic board 430 has a body portion 632, a first tab 634 and a second tab 636. The first tab 634 is provided at one end of the body portion 632, and the second tab 636 is provided at an opposite end of the body portion 632. In some embodiments the distance between the first tab 634 and the second tab 636 approximately corresponds to the length of the memory module (see FIG. 7A). In some embodiments, the distance between the first tab 634 and the second tab 636 corresponds to the length of the connector 200 (see FIG. 7A).

The logic board 430 is made using any suitable techniques and materials, as will be known to those of skill in the art. In some embodiments a generally rectangular logic board 430 is formed, and the logic board is cut to form the main body portion 632, first tab 634, and second tab 636.

As discussed herein, connector 200 may be electrically and mechanically attached to the logic board 430. The connector 200 is positioned on body portion 632 between first tab 634 and second tab 636. In some embodiments, connector 200 is positioned at an edge of the body portion 632 of logic board 430. In some embodiments board conforming portions 210 conform to the first and second tabs 634, 636.

Connector 200 is shown including a support element 550 having support tabs 558, and a support attachment element 560.

Support tabs 558 are attached to first and second tabs 634, 636 of logic board 430, as described herein with reference to FIG. 5.

The support element 550 extends laterally away from connector 200 and main body portion 632, and is generally parallel to first and second tabs 634, 636 of logic board 430.

Figure 7A:
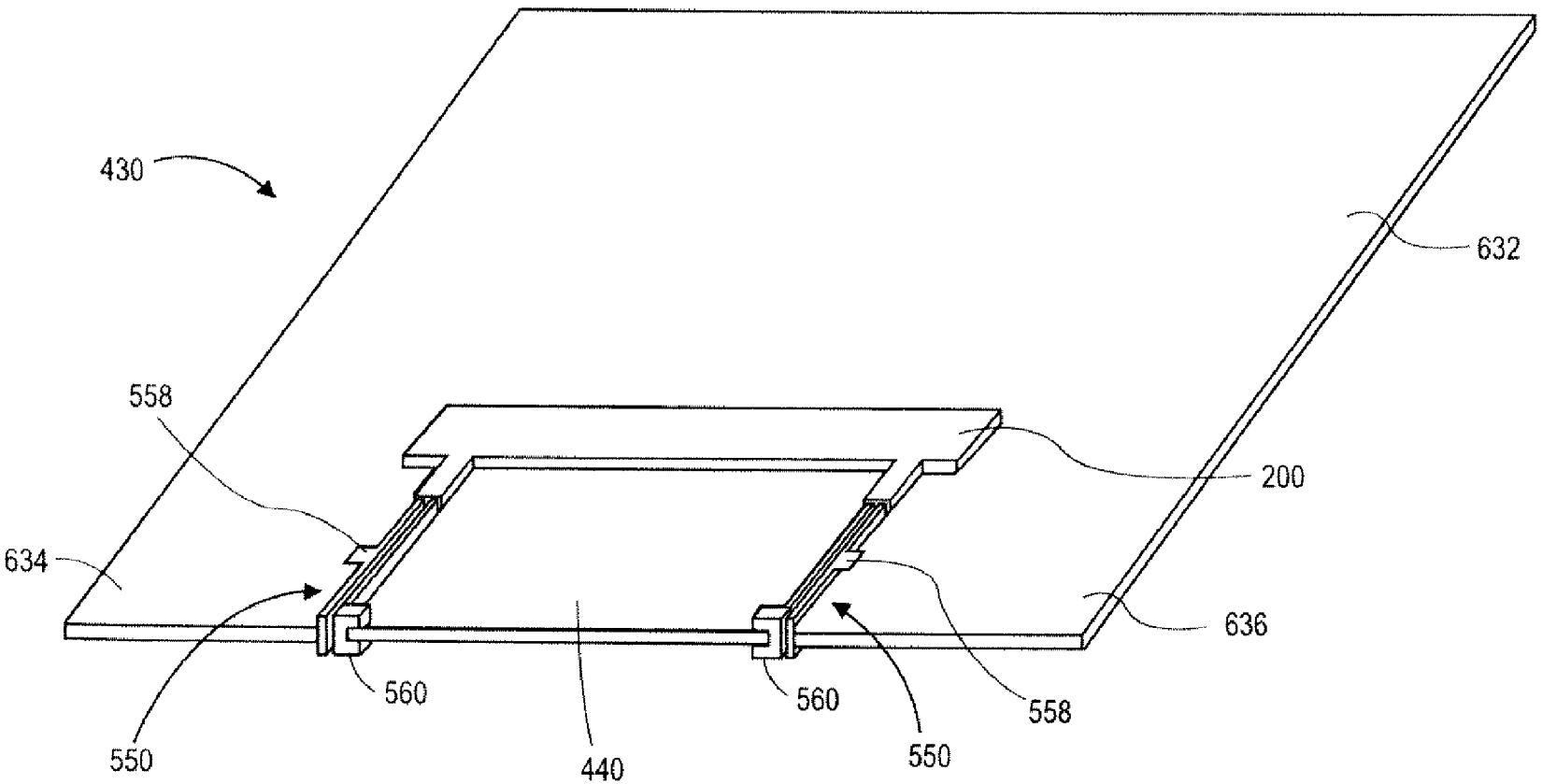
FIG. 7A is a perspective view of a logic board, connector, and memory module assembly in accordance with one embodiment of the present invention.
Figure 9:
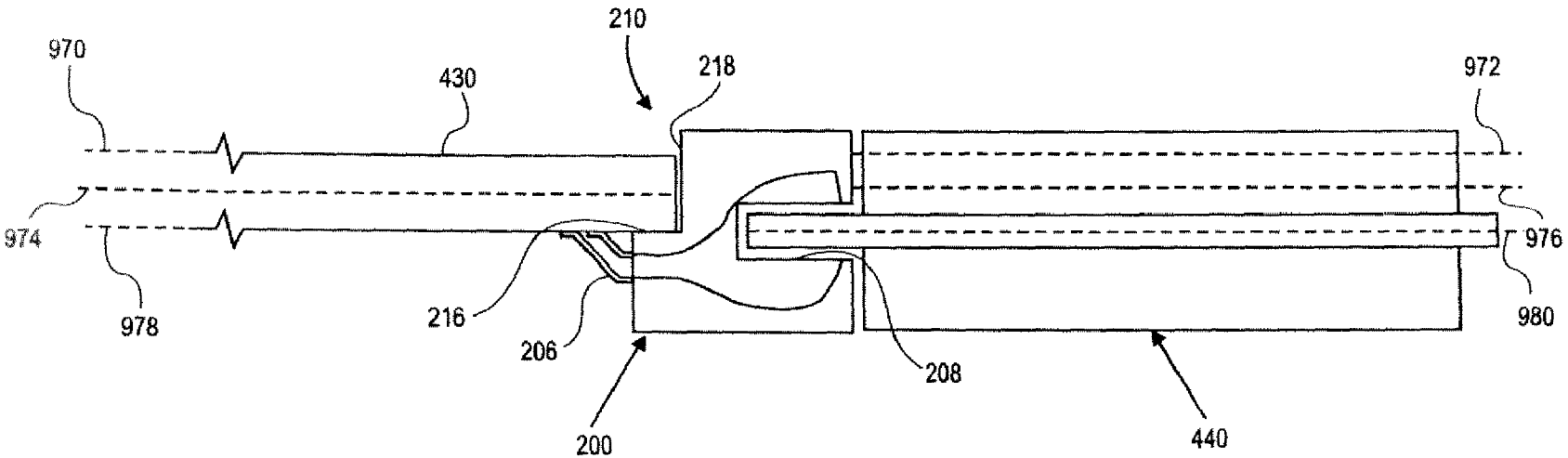
FIG. 9 is a schematic side view of one embodiment of the logic board, connector, and memory module assembly.

With reference to FIG. 7A, in accordance with one embodiment of the present invention, a memory module 440 is shown inserted into connector 200, which is attached to a logic board 430. The memory module 440 may be at least partially coplanar with the logic board 430. FIG. 9 shows an example of how the memory module 440 may be at least partially coplanar with the logic board 430. In this case, at least one longitudinal plane through both boards (e.g., memory module 440 and logic board 430) is common and hence in the same plane. In another case (e.g., FIG. 11), at least one longitudinal plane through the logic board (e.g., a memory module) is common and hence in the same plane.

Connector 200 is shown with a support element 550 having support tabs 558, and a support attachment element 560.

Support tabs 558 are attached to first and second tabs 634, 636 (e.g. the support tabs 558 rest on the tabs 634 and 636) of logic board 730, as described herein with reference to FIG. 5.

Memory module 440 is inserted into connector 200 at connector slot (part 208 in FIG. 2). The memory module 440 may additionally be secured in place with the support attachment element 560 attached to support element 550.

Memory module 440 is shown as being entirely within the perimeter of the logic board (where the perimeter is considered in this case to extend between the tabs 634 and 636). In some other embodiments, only a portion of the memory module fits within the perimeter of the logic board. In still other embodiments, none of the memory module is within the perimeter of the logic board.

With reference to FIG. 73, in accordance with one embodiment of the present invention, a memory module 440 is shown inserted into connector 200, which is attached to a logic board 430.

In some embodiments, logic board 430 has a first body portion 732, a first tab 734, a second tab 736, and a second body portion 738 (such that a rectangular opening is provided in the logic board 430). The first tab 734 is provided at one end of the first body portion 732 and second body portion 738, and the second tab 736 is provided at an opposite end of the first body portion 732 and second body portion 738. In some embodiments, the distance between the first tab 734 and the second tab 736 approximately corresponds to the length of the memory module. In some embodiments, the distance between the first tab 734 and the second tab 736 corresponds to the length of the connector 200. In some embodiments, the distance between the first body portion 732 and the second body portion 738 approximately corresponds to the width of the memory module 440.

The logic board 430 is made using any suitable techniques and materials, as will be known to those of skill in the art. In some embodiments, a generally rectangular logic board 430 is formed, and the logic board is cut to form the first body portion 732, first tab 734, and second tab 736, and second body portion 738.

As discussed herein, connector 200 may be electrically and mechanically attached to the logic board 430. The connector 200 is positioned on either first body portion 732 or second body portion 738 between first tab 734 and second tab 736. In some embodiments, connector 200 is positioned at an edge of the first body portion 732 or second body portion 734 of logic board 430. In some embodiments board conforming portions 210 conform to the first and second tabs 734, 736.

Connector 200 is shown including a support element 550 having support tabs 558, and a support attachment element 560. Support tabs 558 are attached to first and second tabs 734, 736 of logic board 430, as described herein with reference to FIG. 5. The support element 550 extends laterally away from connector 200, and is generally parallel to first and second tabs 734, 736 of logic board 430.

The memory module 440 may be at least partially coplanar with the logic board 430. FIG. 9 shows an example of how the memory module 440 may be at least partially coplanar with the logic board 430. In this case, at least one longitudinal plane through both boards (e.g., memory module 440 and logic board 430) is common and hence in the same plane. In another case (e.g., FIG. 11), at least one longitudinal plane through the logic board (e.g., a memory module) is common and hence in the same plane.

Memory module 440 is inserted into connector 200 at connector slot (part 208 in FIG. 2). The memory module 440 may additionally be secured in place with the support attachment element 560 attached to support element 550.

Memory module 440 is shown as being entirely within the perimeter of the logic board (where the perimeter is considered in this case to extend between the tabs 734 and 736 and body portions 732 and 738).

Figure 8:
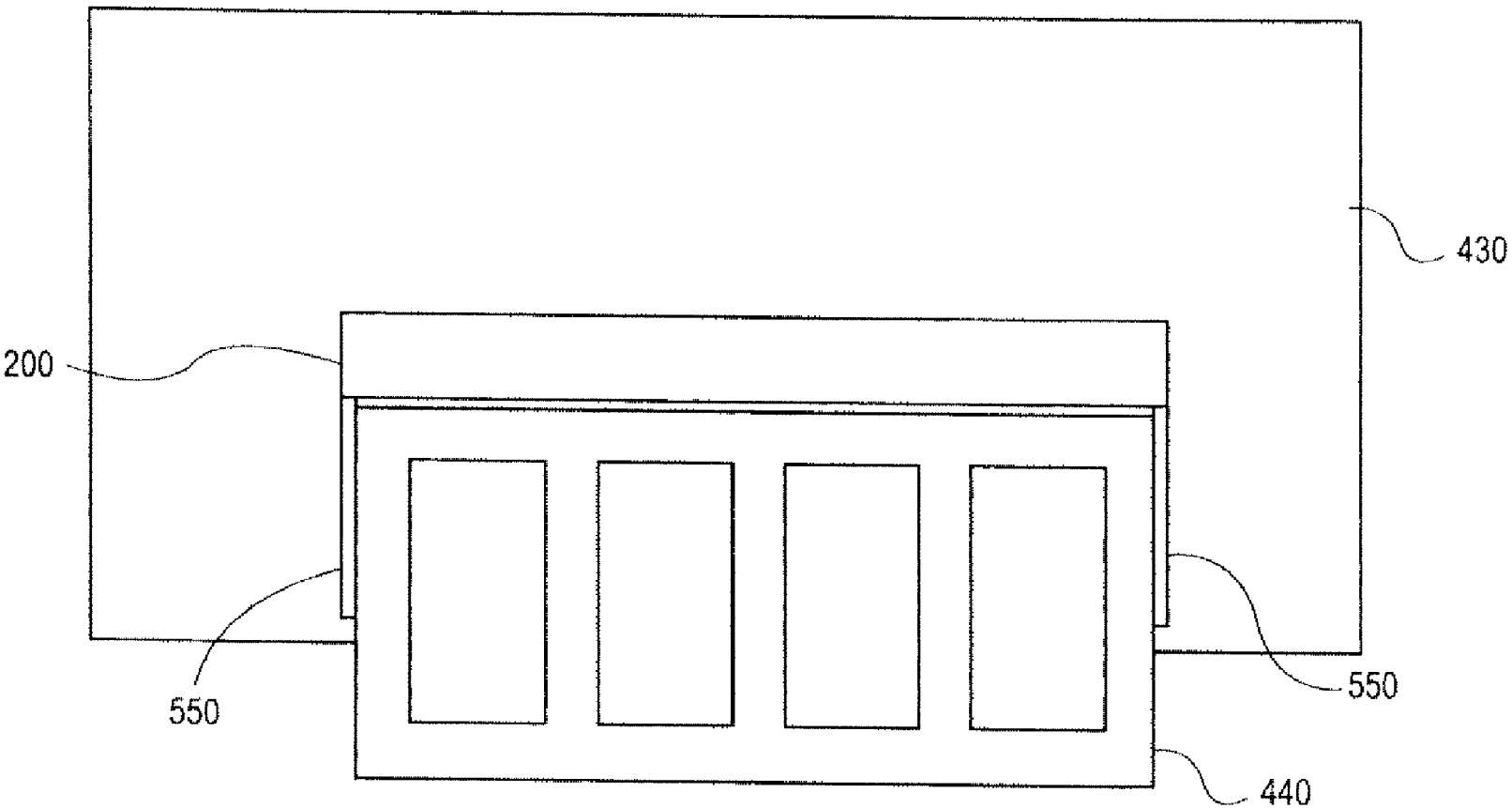
FIG. 8 is a schematic bottom view of a logic board, connector, and memory module assembly in accordance with one embodiment of the present invention.

FIG. 8 is a bottom view showing a connector 200 with a support element 550, attached to the logic board 430, and a memory module 440 inserted into the connector 200. An embodiment wherein only part of the memory module fits within the perimeter of the logic board is illustrated in FIG. 8. In some embodiments, support element 550 supports only a portion of the memory module. The amount of the memory module which the support element supports may be any value or range of values up to and including the entire memory module.

FIG. 9 is a side view showing the memory module 440 connected to the logic board 430 via a connector 200, such that at least a portion of the memory module 440 is at least partially coplanar with the logic board 430.

Logic board includes a first axis 970 corresponding to a first longitudinal plane through the logic board. A corresponding axis 972 is shown through the memory module, corresponding to a first longitudinal plane through the memory module. The first longitudinal plane through the logic board, represented by axis 970, and the first longitudinal plane through the memory module, represented by axis 972, are coplanar. Logic board also includes a second axis 974 corresponding to a second longitudinal plane through the logic board. A corresponding axis 976 is shown through the memory module, corresponding to a second longitudinal plane through the memory module. The second longitudinal plane through the logic board, represented by axis 974, and the second longitudinal plane through the memory module, represented by axis 976, are coplanar. Logic board also includes a third axis 978 corresponding to a third longitudinal plane through the logic board. A corresponding axis 980 is shown through the memory module, corresponding to a third longitudinal plane through the memory module. The third longitudinal plane through the logic board, represented by axis 978, and the third longitudinal plane through the memory module, represented by axis 980, are coplanar.

As described above, a portion of the memory module (e.g., a printed circuit board (PCS) of the memory module or the circuitry, such as an IC, attached to the PCB of the memory module) is at least partially coplanar with a portion of the logic board, which is typically a PCB. It will be appreciated circuit components, such as integrated circuits (e.g., a microprocessor) will typically be mounted on the logic board 430 and will extend perpendicularly away from the axis 974; for example, integrated circuits may be mounted on either side (upper or lower surfaces) of the logic board 430. As illustrated, each of the planes of the logic board between the planes represented by axis 970 and 978 are coplanar with each of the planes of the memory module between the planes represented by axis 972 and 980, respectively. It is envisioned that there may be embodiments wherein only one longitudinal plane of the logic board is coplanar with one longitudinal plane of the memory module. It is also envisioned that there may be embodiments wherein the entire logic board is coplanar with the memory module. Similarly, the axes shown need not he the only axes representing coplanar planes.

In some embodiments, the plurality of contacts 206 are surface-mounted to the logic board 430. Surface-mounting is well known to those of skill in the art, and therefore will not be discussed in more detail. In some embodiments, the plurality of contacts 206 are thru-hole mounted to the logic board 430. Thru-hole mounting is commonly known to those of skill in the art, and will not be discussed in further detail. In some other embodiments, some of the plurality of contacts 206 are thru-hole mounted and some of the plurality of contacts 206 are surface-mounted.

Connector 200 is shown attached to one side of logic board. In an alternative embodiment, the connector 200 may be attached to the other side of the logic board.

Board conforming portion is shown conforming to two sides of the logic board. First conforming wall 216 contacts the bottom surface of the logic board (also represented by axis 978). Second conforming wall 218 contacts the end surface of the logic hoard.

Figure 1:
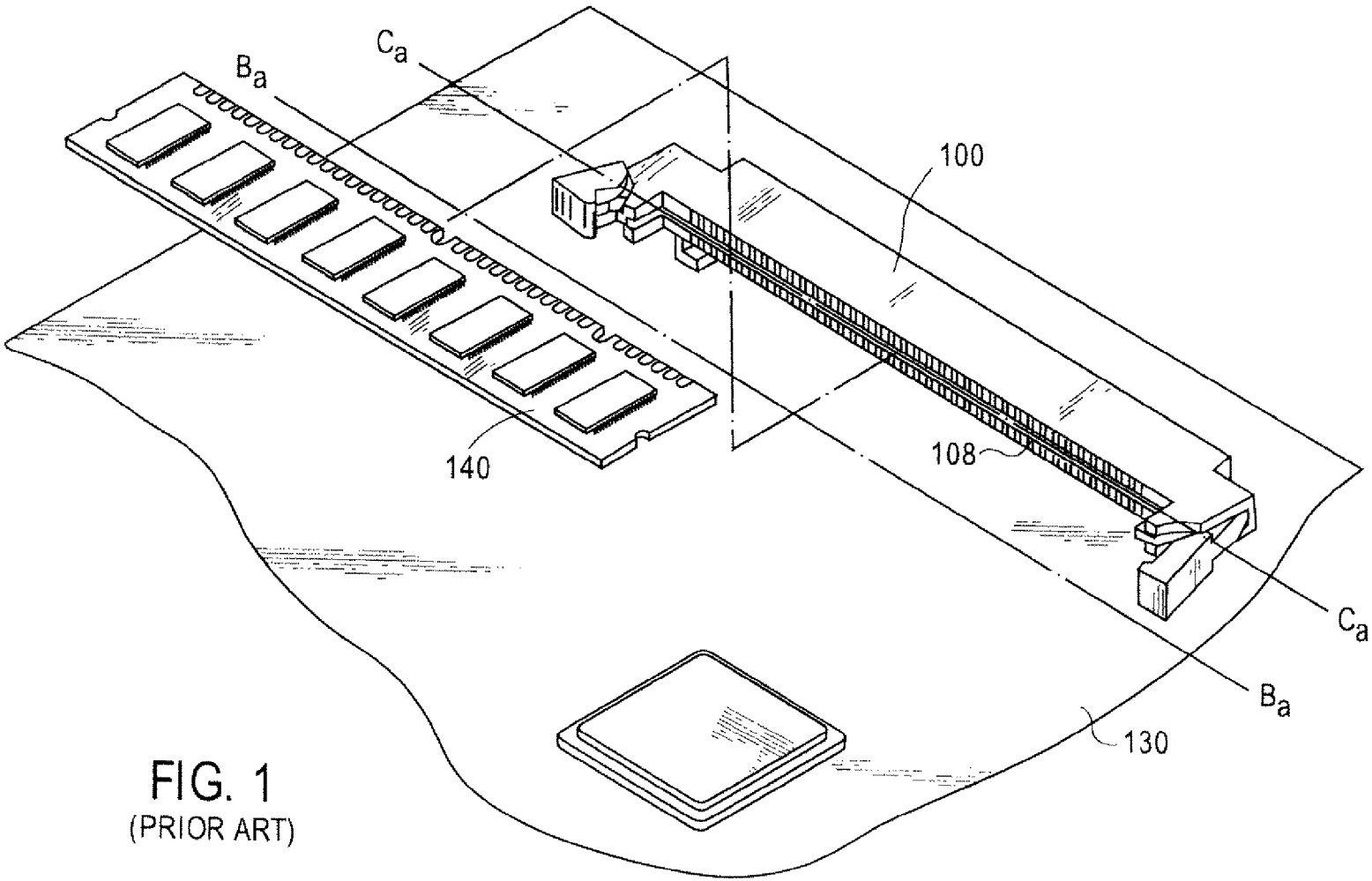
FIG. 1 (PRIOR ART)
FIG. 1 is a perspective view of a connector for a logic board of the prior art.
Figure 1A:
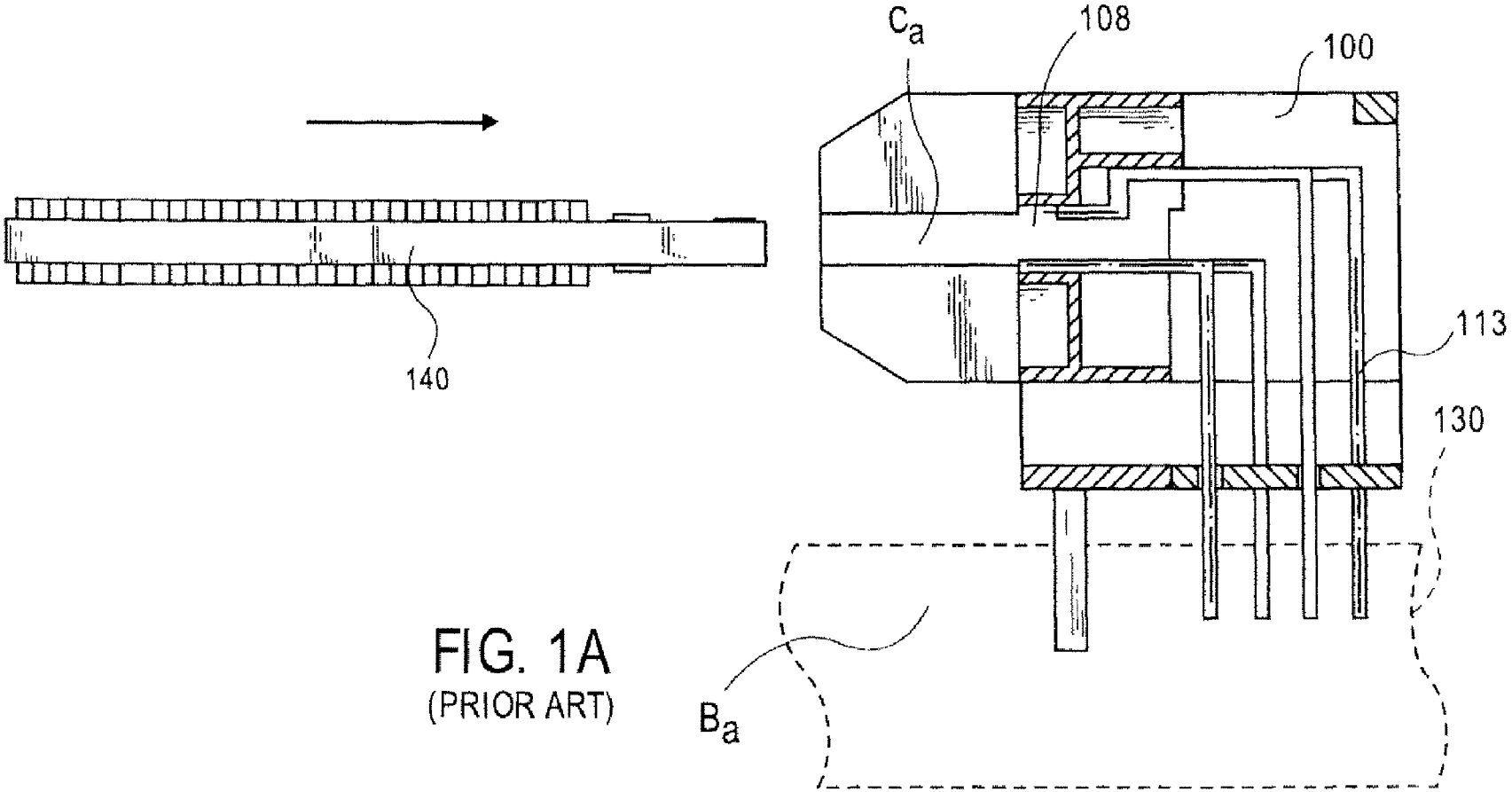
FIG. 1A (PRIOR ART)
FIG. 1A is a cross-sectional view of the connector of the prior art.
Figure 10:
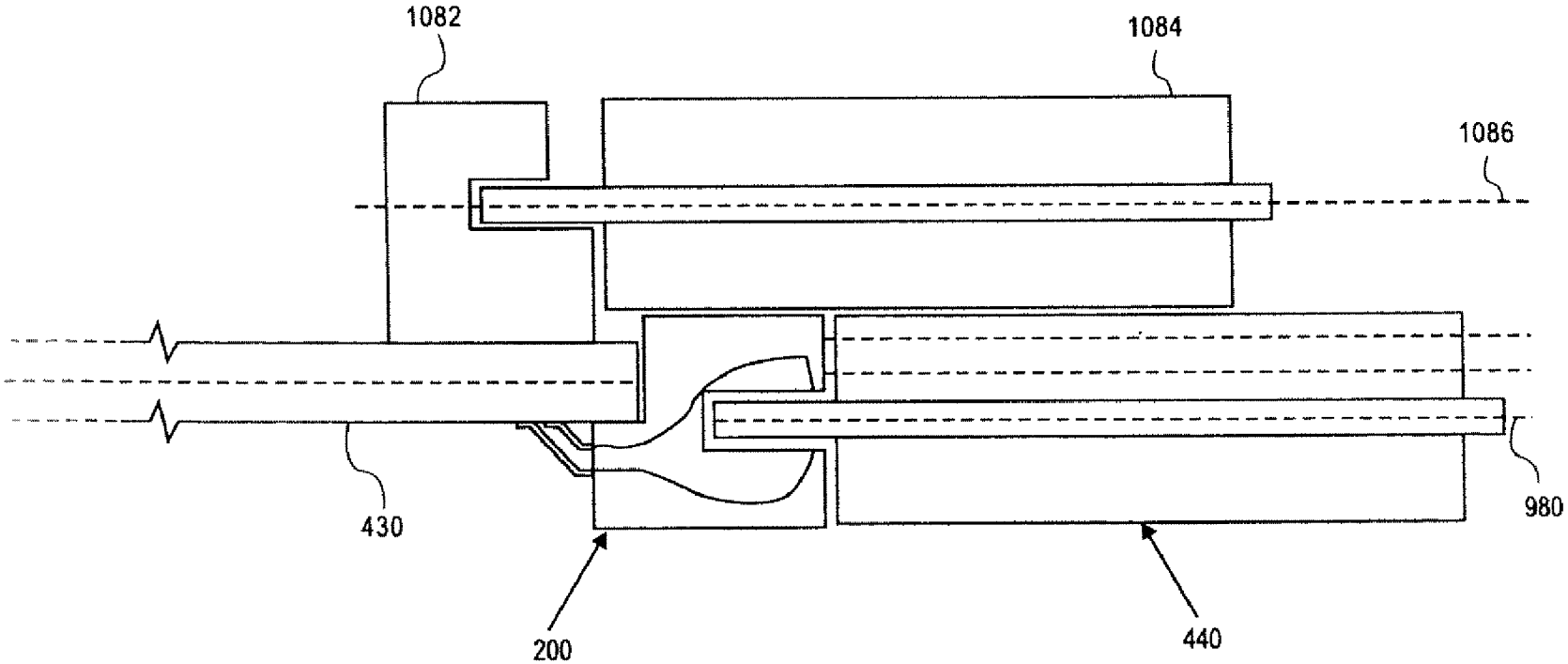
FIG. 10 is a schematic side view of one embodiment of the logic board, connector. and memory module assembly.

FIG. 10 is a side view showing the memory module 440 connected to the logic board 430 via a connector 200, as described with reference to FIG. 9. In some embodiments, a second connector 1082 may be attached to the other side of the logic board 430. such that two memory modules (or other types of logic boards) can be used. In some embodiments, the second connector 1082 may be similar to a connector of the prior art, as described above with reference to FIGS. 1-1A. A longitudinal axis 1086 extends through the second memory module 1084 and is parallel to a longitudinal axis 980 extending through the first memory module 440, but the axis 1086 is not coplanar with any plane which is parallel with and within the logic board 430.

Connector 200 is shown attached to the bottom surface of the logic hoard, and the second connector 1084 is shown attached to the top surface of the logic board. Alternatively, the second connector 1084 may be attached to the bottom surface of the logic board, and connector 200 may be attached to the top surface of the logic board.

Figure 11:
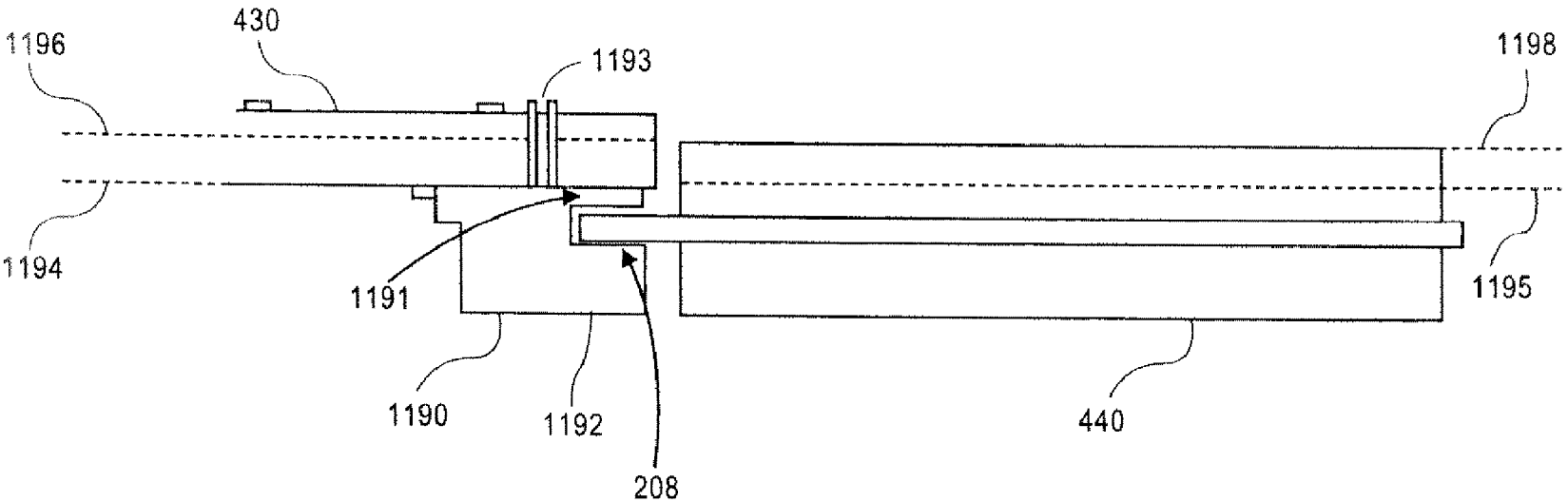
FIG. 11 is a schematic side view of one embodiment of the logic board, connector, and memory module assembly.

FIG. 11 is a side view showing a memory module 440 connected to a logic board 430 via a connector 1190, such that at least a portion of the memory module 440 is at least partially coplanar with the logic board 430.

Connector 1190 includes a body, a plurality of contacts (not shown), and a connection slot 208. Connector body includes a first extending portion 1191 and a second extending portion 1192. Unlike connector 200, connector 1190 does not conform to a corner of the logic board. Connector 1190 is shown contacting the top surface of the logic board 430. The first extending portion is shorter than a first extending portion of a standard connector (see FIG. 12), thereby reducing the total height of the connector. In one embodiment, the height of connector 1190 is about 3.0 mm. The height of a standard connector is about 5.0 mm.

Logic board includes a first axis 1194 corresponding to a first longitudinal plane through the logic board. A corresponding axis 1195 is shown through the memory module, corresponding to a first longitudinal plane through the memory module. The first longitudinal plane through the logic board, represented by axis 1194, and the first longitudinal plane through the memory module, represented by axis 1195, are coplanar. Logic board also includes a second axis 1196 corresponding to a second longitudinal plane through the logic board. A corresponding axis 1198 is shown through the memory module, corresponding to a second longitudinal plane through the memory module. The second longitudinal plane through the logic board, represented by axis 1196, and the second longitudinal plane through the memory module, represented by axis 1198, are coplanar.

As described above, a portion of the memory module is at least partially coplanar with a portion of the logic board. As illustrated, each of the planes of the logic board between the planes represented by axis 970 and 978 are coplanar with each of the planes of the memory module between the planes represented by axis 972 and 980, respectively. It is envisioned that there may be embodiments wherein only one longitudinal plane of the logic board is coplanar with one longitudinal plane of the memory module. It is also envisioned that there may be embodiments wherein at least one longitudinal plane through the logic board is coplanar with a longitudinal plane running through components directly coupled to another board (e.g., a memory module). It is also envisioned that there may be embodiments wherein the entire logic board is coplanar with the memory module. Similarly, the axes shown need not be the only axes representing coplanar planes.

In some embodiments, logic board includes thru-hole leads 1193, for thru-hole mounting connector 200 to the logic board 430. In some embodiments, the plurality of contacts 206 are surface-mounted to the logic board 430. In some other embodiments, some of the plurality of contacts 206 are thru-hole mounted and some of the plurality of contacts 206 are surface-mounted.

Figure 12:
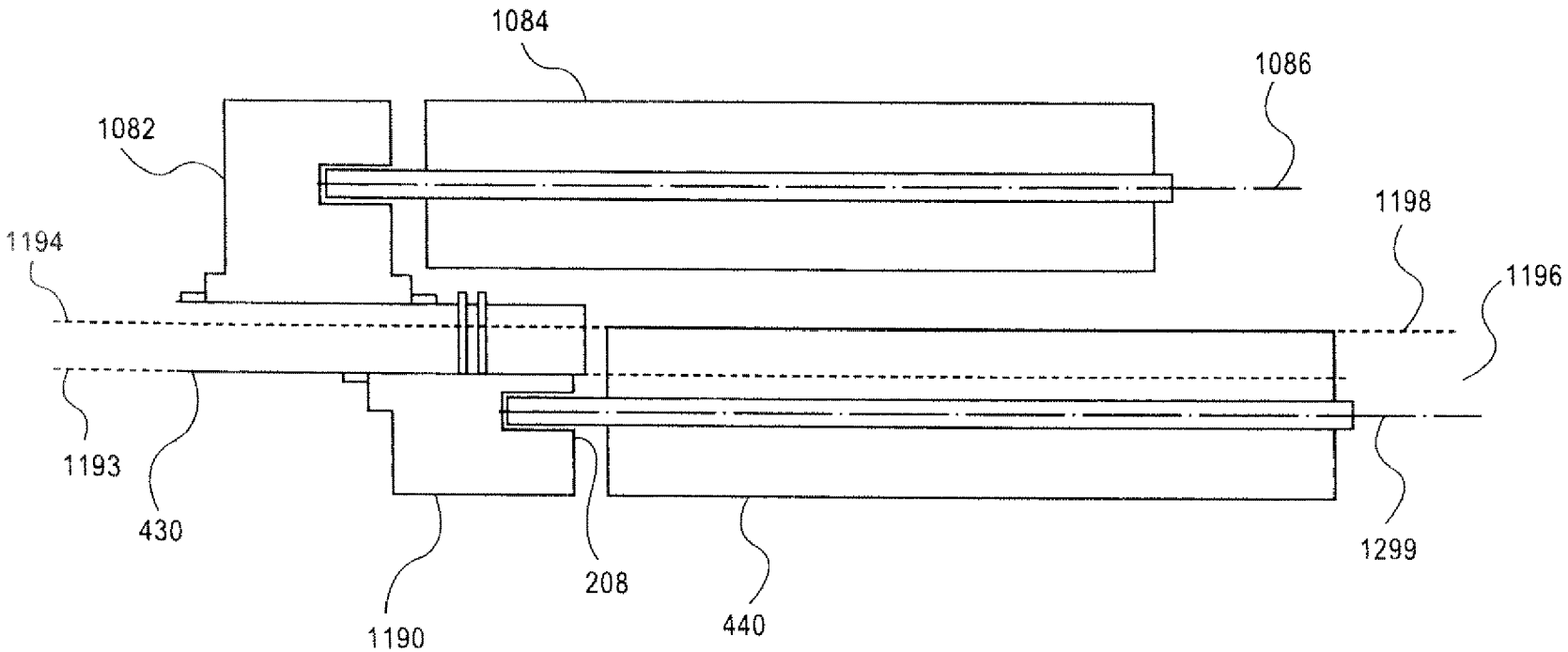
FIG. 12 is a schematic side view of one embodiment of the logic board, connector, and memory module assembly.

FIG. 12 is a side view showing the memory module 440 connected to the logic board 430 via a connector 1190, as described with reference to FIG. 11. A second connector 1082 may be attached to the other side of the logic board 430, such that two memory modules (or other types of logic modules) may be provided. A longitudinal axis 1086 extends through the second memory module 1084 and is parallel to a longitudinal axis 1299 extending through the first memory module 440.

Figure 13:
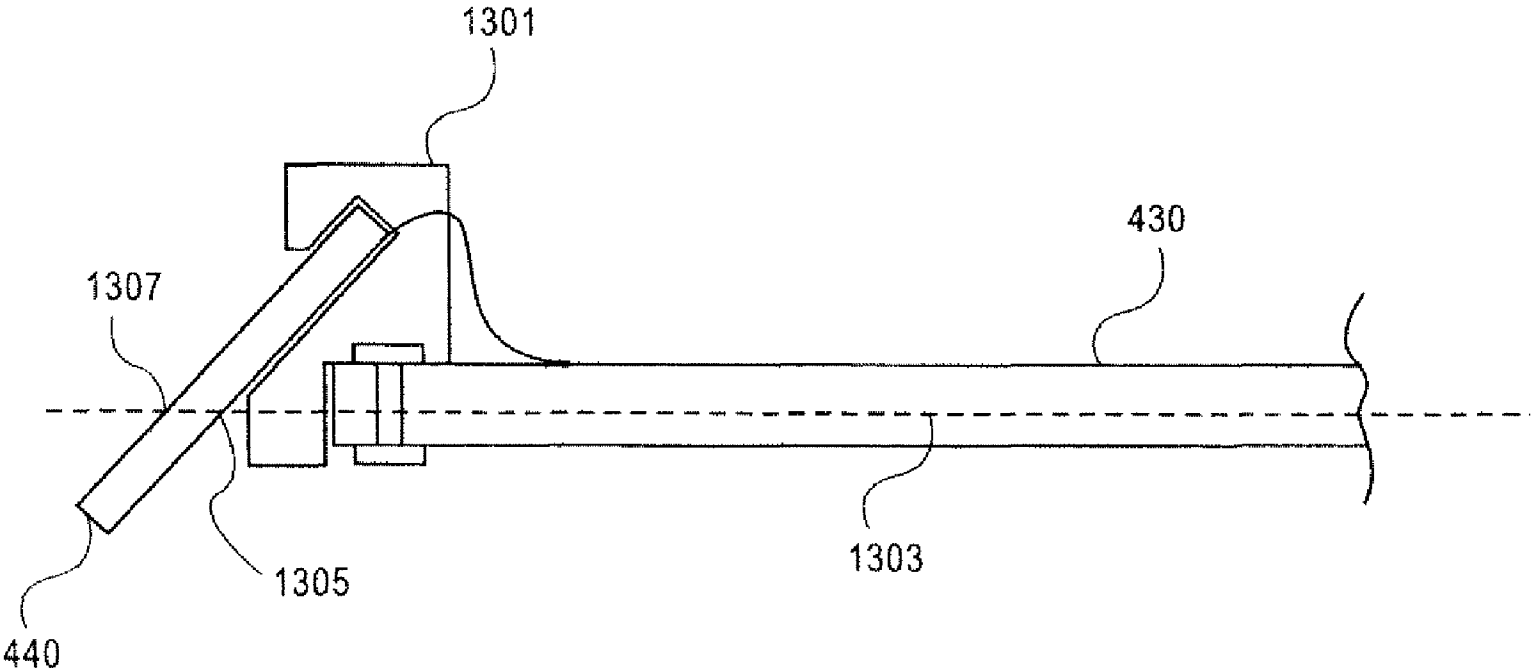
FIG. 13 is a schematic side view of one embodiment of the logic board, connector, and memory module assembly.

FIG. 13 is a side view showing the memory module 440 connected to the logic board 430 via a connector 1301, such that at least one plane through the logic board 430 crosses the memory module 440 at at least one point.

Connector 1301 includes contacts 206 and a mechanical attachment element. The memory module 440 is positioned in connector 1301 at an angle relative to a longitudinal plane through the logic board. In some embodiments, the angle is from about 1° to about 89°, and in some embodiments, the angle is from about 20° to about 70°, and, in one embodiment, the angle is about 45°.

Logic board includes a first axis 1303 corresponding to a first longitudinal plane through the logic board. A first point 1305 corresponds to a first point on the memory module, at which the first longitudinal plane through the logic board, represented by first axis 1303, intersects the memory module 440. A second point 1307 is another point on the memory module, at which the first longitudinal plane through the logic board, represented by first axis 1303, intersects the memory module 440.

It will be appreciated that circuit components, such as integrated circuits (e g., a microprocessor) will typically be mounted on the logic board 430 and will extend perpendicularly away from the axis 1303; for example, integrated circuits may be mounted on either side (upper or lower surfaces) of the logic board 430. It is envisioned that there may be embodiments wherein only one longitudinal plane of the logic board intersects the memory module. However, there may be several longitudinal planes of the logic board that intersect the memory module. Similarly, the points shown need not be the only points representing points of intersection.

In some embodiments, the plurality of contacts 206 are surface-mounted to the logic board 430. In some embodiments, the plurality of contacts 206 are thru-hole mounted to the logic board 430. In some other embodiments, some of the plurality of contacts 206 are thru-hole mounted and some of the plurality of contacts 206 are surface-mounted.

Connector 200 is shown attached to one side of logic board. In an alternative embodiment, the connector 200 may be attached to the other side of the logic board.

Figure 14:
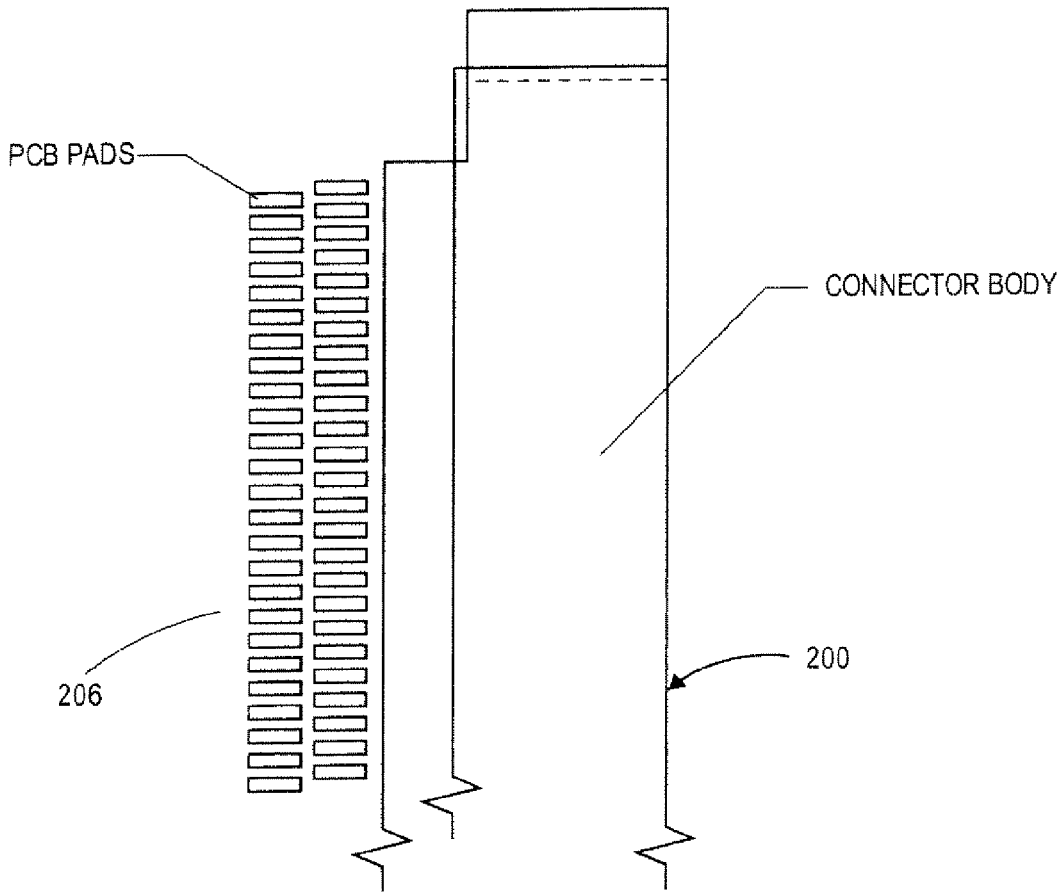
FIG. 14 is a partial schematic top view showing the connector contacts in accordance with one embodiment of the present invention.

FIG. 14 is a detailed schematic view showing the electrical connections of contacts 206 (first contacting portion 422 as described above with reference to FIG. 4A). In some embodiments, connector 200 includes a high number of electrical connections. In some embodiments, the number of electrical connections is any value or range of values between about 30 and about 500. The actual number of electrical connections may be below or above this range. In one embodiment, the number of electrical connections is about 200.

Figure 15:
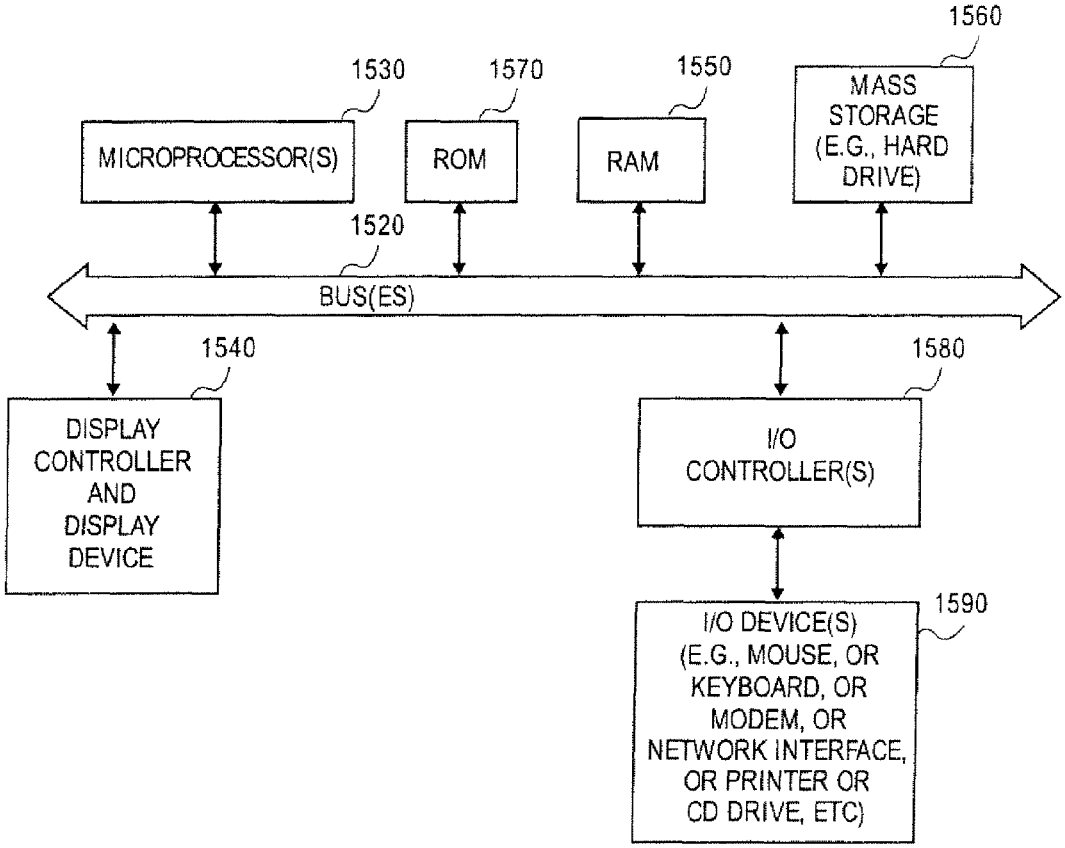
FIG. 15 is a schematic view of a computer system in accordance with one embodiment of the present invention.

FIG. 15 shows one example of a typical computer system which may be used with the present invention. Note that while FIG. 15 illustrates various components of a computer system, it is not intended to represent any particular architecture or manner of interconnecting the components as such details are not germane to the present invention. It will also be appreciated that network computers and other data processing systems which have fewer components or perhaps more components may also be used with the present invention. The computer system of FIG. 15 may, for example, be a Macintosh computer from Apple Computer, Inc.

As shown in FIG. 15, the computer system 1510, which is a form of a data processing system, includes a bus 1520 which is coupled to a microprocessor(s) 1530 and a ROM (Read Only Memory) 1570 and volatile RAM 1550 and a non-volatile memory 1560. The microprocessor 1530 may be a G3 or G4 microprocessor from Motorola, Inc. or one or more G5 microprocessors from IBM. The bus 1520 interconnects these various components together and also interconnects these components 1530, 1570, 1550, and 1560 to a display controller and display device 1540 and to peripheral devices such as input/output (I/O) devices which may be mice, keyboards, modems, network interfaces, printers and other devices which are well known in the art. Typically, the input output devices 1590 are coupled to the system through input/output controllers 1580. The volatile RAM (Random Access Memory) 1550 is typically implemented as dynamic RAM (DRAM) which requires power continually in order to refresh or maintain the data in the memory. The RAM 1550 may be disposed on one or more of the memory modules described herein, such as memory module 440. The mass storage device 1560 is typically a magnetic hard drive or a magnetic optical drive or an optical drive or a DVD RAM or other types of memory systems which maintain data (e.g., large amounts of data) even after power is removed from the system. Typically, the mass storage 1560 will also be a random access memory although this is not required. While FIG. 15 shows that the mass storage 1560 is a local device coupled directly to the rest of the components in the data processing system, it will be appreciated that the present invention may utilize a non-volatile memory which is remote from the system, such as a network storage device which is coupled to the data processing system through a network interface such as a modem or Ethernet interface. The bus 1520 may include one or more buses connected to each other through various bridges, controllers and/or adapters as is well known in the art. In one embodiment the I/O controller 1580 includes a USB (Universal Serial Bus) adapter for controlling USB peripherals and an IEEE 1394 controller for IEEE 1394 compliant peripherals.

One advantage of the present invention is that the connector allows a memory expansion slot on products which have less than 4 mm of space between the logic board and the enclosure, housing or other obstruction. Another advantage of the present invention is that the connector creates more clearance for airflow.

Although the present invention has been described in terms of certain preferred embodiments, those skilled in the art will recognize that other and further changes and modifications may be made hereto without departing from the spirit of the invention, and it is intended to claim all such changes and modifications as fall within the true scope of the invention. Accordingly, the scope of the present invention is not to be limited by the particular embodiments described, but is to be defined only by reference to the appended claims and equivalents thereof.

What is claimed is:

1. A system, comprising:

a housing;

a logic board having a longitudinal plane disposed within the housing;

a memory module; and a connector, attached to the logic board, and configured to receive the memory module, wherein at least a portion of the memory module is at least partially coplanar with the longitudinal plane of the logic board, and wherein the housing is in close proximity to a surface of the memory module such that a space between the housing and the logic board is less than 4 mm, and wherein the housing and the connector are two separate units.

2. The system of claim 1, wherein the logic board is configured to receive the memory module within a perimeter of the logic board.

3. The system of claim 1, wherein the connector is releasably attached to the logic board.

4. The system of claim 1, wherein the memory module is releasably attached to the connector.

5. The system of claim 1, wherein the logic board is configured to receive at least a portion of the memory module within the perimeter of the logic board.

6. A system, comprising:

a housing;

a logic board having a longitudinal plane;

an auxiliary logic board having circuitry thereon; and a connector having a body configured to be attached to the logic board, and configured to receive the auxiliary logic board, wherein at least a portion of the auxiliary logic board is coplanar with the longitudinal plane of the logic board, and wherein a space between the housing and the logic board is less than 4 mm.

7. The system of claim 6, wherein the logic board is configured to receive the auxiliary logic board within a perimeter of the logic board.

8. The system of claim 6, wherein the auxiliary logic board comprises a memory module.

9. The system of claim 6, wherein the auxiliary logic board is releasably attached to the connector.

10. The system of claim 6, wherein the connector is releasably attached to the logic board.

11. The system of claim 6, wherein the logic board is configured to receive at least a portion of the auxiliary logic board within the perimeter of the logic board.

12. A system, comprising:

a housing;

a logic board having a longitudinal plane;

a first memory module, positioned coplanar to the longitudinal plane of the logic board;

a first connector having a body configured to be attached to one side of the logic board, and configured to receive the first memory module; and a second connector having a body configured to be attached to another side of the logic board, and configured to receive a second memory module, and wherein a space between the housing and the logic board is less than 4 mm.

13. An apparatus, comprising:

a housing;

a connector body configured to contact at least two perpendicular sides of a logic board; and a connecting element, attached to the connector body and configured to receive an auxiliary logic board, wherein a space between the housing and the logic board is less than 4 mm.

14. The apparatus of Claim 13, wherein the connector body includes a support body, a first extension attached to the connector body, and a second extension parallel to the first extension and attached to the connector body.

15. The apparatus of claim 14, wherein the first extension and second extension surround the connecting element.

16. The apparatus of claim 14, wherein the support body is configured to conform to at least two sides of the logic board.

17. The apparatus of claim 16, wherein at least two sides comprise a corner.

18. The apparatus of claim 17, wherein the support body includes an opening configured to conform to the corner of the logic board.

19. A system. comprising:

a housing;

a logic board having a body and a first tab and a second tab;

a connector attached to the logic board; and a support rail, attached to the connector and the logic board, wherein a space between the housing and the logic board is less than 4 mm.

20. The system of claim 19, further comprising an auxiliary logic board, wherein the support rail is configured to support an edge of the auxiliary logic board.

21. The system of claim 20, wherein the auxiliary logic board is adapted to be positioned at least partially coplanar with the logic board.

22. The system of claim 19, wherein the support rail includes an extension configured to attach the support rail to the logic board.

23. The system of claim 22, wherein the extension of the support rail is attached to the first tab.

24. The system of claim 22, wherein the extension of the support rail is attached to the second tab.

25. The system of claim 19, wherein the support rail includes a first extension configured to attach to the first tab, and a second extension configured to attach to the second tab.

26. The system of claim 22, wherein the extension of the support rail extends laterally away from the connector and extends laterally toward the logic board.

27. The system of claim 19, wherein the support rail is releasably attached to the connector.

28. The system of claim 19, further comprising a lock for locking an auxiliary logic board in the connector.

29. The system of claim 28, wherein the lock is attached to the support rail.

30. The system of claim 28, wherein the lock is integrally formed with the support rail.

31. The system of claim 28, wherein the lock is adapted to lock the auxiliary logic board within the perimeter of the logic board.

32. A system, comprising:

a housing;

a logic board having a longitudinal plane;

a card, positioned coplanar to the longitudinal plane of the logic board; and a connector attached to the logic board, and configured to receive the card, wherein the connector includes a support rail, wherein the support rail extends laterally away from the connector, and wherein the support rail is configured to receive the card, wherein a space between the housing and the logic board is less than 4 mm.

33. The system of claim 32, wherein the card comprises a memory module.

34. A system, comprising:

a logic board having a body, a first tab, a second tab, and a longitudinal plane running through the body, first tab, and second tab;

a card, positioned at least partially coplanar to the longitudinal plane of the logic board, having at least one edge; and a connector, attached to the logic board, and configured to receive the card, wherein the connector includes a support rail, and wherein the support rail extends laterally away from the connector to the first and second tabs, and wherein the support rail is configured to support the at least one edge of the card.

35. The system of claim 34, wherein the card comprises a memory module.

36. A system, comprising:

a housing;

a logic board having a longitudinal plane;

an auxiliary logic board, positioned coplanar to the longitudinal plane of the logic board, having a high number of discrete connections; and a connector, attached to the logic board, and configured to receive the auxiliary logic board, wherein the connector includes a high number of discrete connections corresponding to the high number of discrete connections of the auxiliary logic board, wherein a space between the housing and the logic board is less than 4 mm.

37. The system of claim 36, wherein the auxiliary logic board comprises a memory module.

38. A system, comprising:

a logic board having a longitudinal plane;

a first auxiliary logic board having a longitudinal plane, positioned coplanar to the longitudinal plane of the logic board;

a first connector, attached to the logic board, and configured to receive the first auxiliary logic board;

a second auxiliary logic board, positioned parallel to the longitudinal plane of the first auxiliary logic board; and a second connector, attached to the logic board, and configured to receive the second auxiliary logic board.

39. The system of claim 38, wherein the first connector is attached to a first side of the logic board, and the second connector is attached to a second side of the logic board.

40. The system of claim 38, wherein the first and second auxiliary logic board comprise a memory module.

* * * * *

UNITED STATES PATENT AND TRADEMARK OFFICE

CERTIFICATE OF CORRECTION

PATENT NO. : 7,819,685 B2
APPLICATION NO. : 12/467165
DATED : October 26, 2010
INVENTOR(S) : David A. Hardell It is certified that error appears in the above-identified patent and that said Letters Patent is hereby corrected as shown below:

In column 2, line 9, delete “card.” and insert -- card, --, therefor.

In column 3, line 8, after “provided.” delete “the” and insert -- The --, therefor.

In column 3, line 44, delete “connector.” and insert -- connector, --, therefor.

In column 4, line 17, delete “PC27001” and insert -- PC2700 --, therefor.

In column 7, line 3, delete “embodiments” and insert -- embodiments, --, therefor.

Figure 7B:
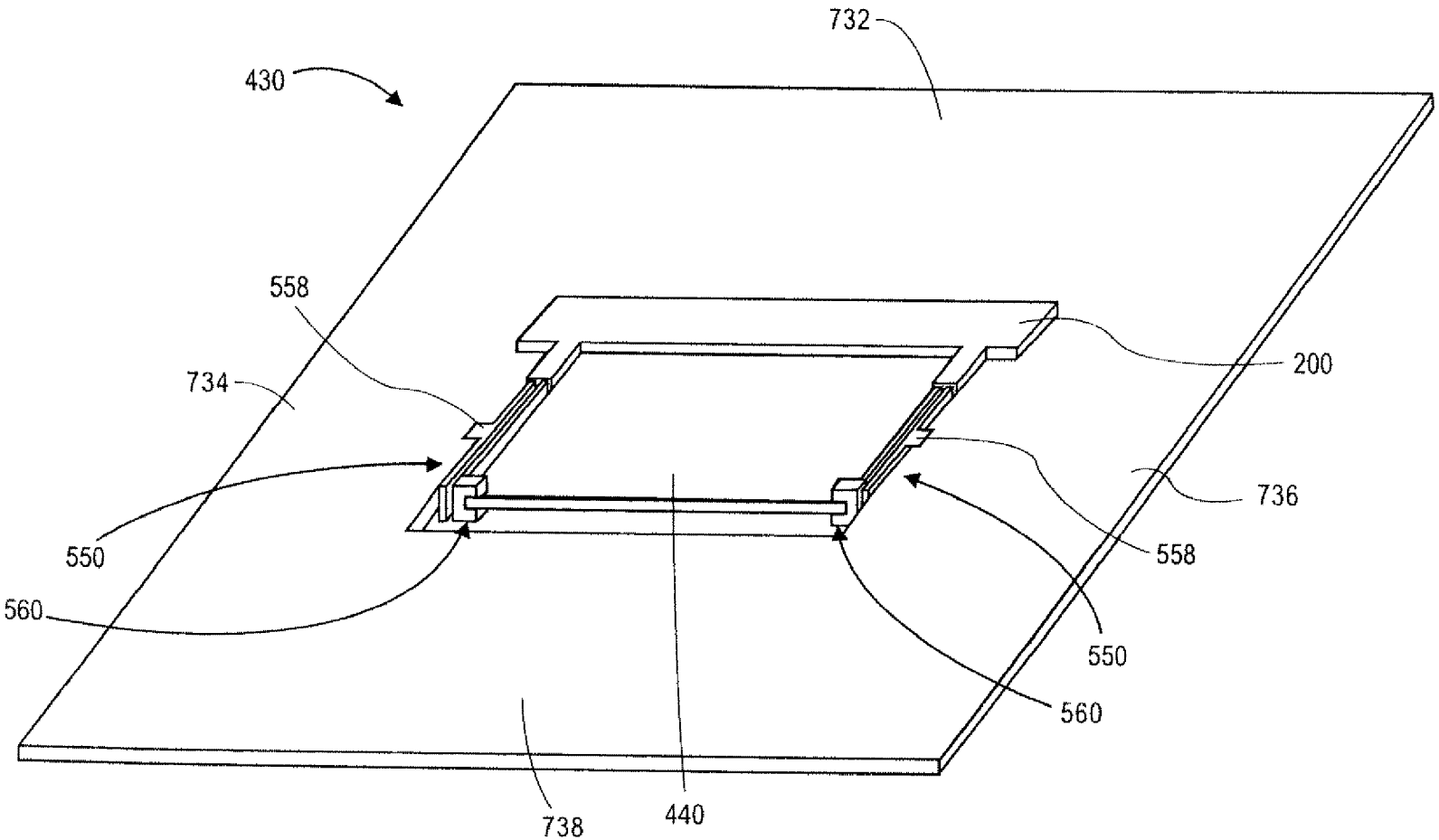
FIG. 7B is a perspective view of a logic board, connector, and memory module assembly in accordance with one embodiment of the present invention.

In column 7, line 58, delete “FIG. 73,” and insert -- FIG. 7B, --, therefor.

In column 9, line 18, delete “(PCS)” and insert -- (PCB) --, therefor.

In column 9, line 36, delete “he” and insert -- be --, therefor.

In column 9, line 54, delete “hoard.” and insert -- board. --, therefor.

In column 9, line 59, delete “430.” and insert -- 430, --, therefor.

In column 10, line 2, delete “hoard,” and insert -- board, --, therefor.

In column 12, line 10, delete “input output” and insert -- input/output --, therefor.

In column 12, line 1, in claim 19, delete “system.” and insert -- system, --, therefor.

Signed and Sealed this
Fifteenth Day of November, 2011

David J. Kappos

David J. Kappos
*Director of the United States Patent and Trademark Office*